US005265351A

United States Patent [19]

Iwama et al.

[11] Patent Number: 5,265,351

[45] Date of Patent: Nov. 30, 1993

[54] SKI BOOT HAVING A CARRYING HANGER PROVIDED ON AN OUTER MEMBER THEREOF

[75] Inventors: Shinichi Iwama; Keigi Tsugami; Masahiro Fukuda; Shigeto Yamada, all of Tokyo, Japan

[73] Assignee: Daiwa Seiko, Inc., Tokyo, Japan

[21] Appl. No.: 848,056

[22] Filed: Mar. 9, 1992

Related U.S. Application Data

[62] Division of Ser. No. 628,908, Dec. 18, 1990, Pat. No. 5,125,172.

[30] Foreign Application Priority Data

Dec. 18, 1989 [JP] Japan ..... 1-145642

[51] Int. Cl.[5] ..... A43B 5/04

[52] U.S. Cl. ..... 36/117; 36/1; 36/136

[58] Field of Search ..... 36/1, 114, 117, 132, 36/136, 138, 71.5, 50.5

[56] References Cited

U.S. PATENT DOCUMENTS

| | | | |
|---|---|---|---|
| 32,490 | 6/1861 | Towers . | |
| 3,790.991 | 2/1974 | Hanson et al. | 36/117 |
| 3,971,144 | 7/1976 | Brügger-Stuker | 36/117 |
| 4,011,634 | 3/1977 | Olivieri | 36/50.5 |
| 4,020,571 | 5/1977 | Olivieri | 36/50.5 |
| 4,083,130 | 4/1978 | Bertetto et al. | 36/117 |
| 4,155,179 | 5/1979 | Weninger | 36/117 |
| 4,411,078 | 10/1983 | Bucheder | 36/50.5 |

FOREIGN PATENT DOCUMENTS

| | | | |
|---|---|---|---|
| 2652654 | 5/1978 | Fed. Rep. of Germany | 36/132 |
| 414439 | 7/1946 | Italy | 36/138 |
| 50-154147 | 12/1975 | Japan . | |
| 52-3853 | 1/1977 | Japan . | |
| 59-3771 | 9/1984 | Japan . | |
| 1-22496 | 1/1986 | Japan . | |

*Primary Examiner*—Steven N. Meyers
*Assistant Examiner*—M. D. Patterson
*Attorney, Agent, or Firm*—Longacre & White

[57] ABSTRACT

The present invention provides a ski boot including an outer member and an inner member inserted therein, in which a carrying hanger is provided in a prescribed position on the outer member and has a taken-out handle so that the hanger can be taken out from the outer member and grasped by the hand of a person for him or her to carry the boot as the hanger remains coupled with the outer member.

10 Claims, 14 Drawing Sheets

SKI BOOT HAVING A CARRYING HANGER PROVIDED ON AN OUTER MEMBER THEREOF

This is a division of application Ser. No. 07/628,908 filed Dec. 18, 1990 now U.S. Pat. No. 5,125,172.

BACKGROUND OF THE INVENTION

The present invention relates to a ski boot, particularly to an easily portable ski boot.

Since a conventional ski boot is larger in size and weight than an ordinary boot or shoe, it is more uneasy to carry the ski boot than to carry the ordinary boot or shoe. For that reason, a carrying means was developed to make it possible to easily carry the ski boot.

Such a carrying means is a looped rubber band as disclosed in the Japanese Utility Model Application No. 22496/79. Another such carrying means is a sheet bag which has a handle at the top of the bag and is put in a ski boot and inflated with air, as disclosed in the Japanese Utility Model application (OPI) No. 3853/77 (the term "OPI" as used herein means an "unexamined published application"). Yet another such carrying means is a special container in which a ski boot is accommodated to be carried with the container, as disclosed in the Japanese Utility Model Applications Nos. 154147/75 and 137771/84. By the carrying means, the ski boots larger in size and weight than an ordinary boot or shoe can be easily carried. However, there is a problem that the carrying means such as the looped rubber band, the sheet bag and the special container, which is provided separately from the ski boot, needs to be prepared separated from the boot and be carried separately from the boot at the time of the non-use thereof. There is another problem that it is troublesome to inflate the sheet bag with the air or put the ski boot in the special case, for example, particularly with glove-wearing hands on a skiing slope in very cold weather or under a similar condition.

SUMMARY OF THE INVENTION

The present invention was made in order to solve the above-mentioned problems.

Accordingly, it is an object of the present invention to provide a ski boot in which a carrying hanger is provided on the outer member of the boot so that a carrying means does not need to be provided separately from the boot and it is easy to put the boot into a portable state and carry the boot. The ski boot includes the outer member, an inner member inserted therein, and the carrying hanger provided in a prescribed position on the outer member. The hanger has a taken-out handle so that the hanger can be taken out from the outer member and grasped by the hand of a person for him or her to carry the ski boot as the hanger remains coupled with the outer member. When the person is to carry the ski boot, his or her fingers are engaged on the taken-out handle of the hanger accommodated in the outer surface of the outer member and the hanger is then put out from the outer surface into such a state that the boot can be carried with his or her hand grasping the hanger. The boot can thus be easily put into the portable state and carried.

It is another object of the present invention to provide a ski boot in which a carrying hanger is provided on the outer member of the boot so that a carrying means does not need to be provided separately from the boot and it is easy to put the boot into a portable state and carry the boot. The ski boot includes the outer member, an inner member inserted therein, and the carrying hanger. The hanger has a taken-out handle so that the hanger can be taken out from the outer member and grasped by the hand of a person for him or her to carry the boot as the hanger remains coupled with the outer member. The coupled arms of the hanger, which extend from the taken-out handle of the hanger, are pivotally coupled to the outer member so that the hanger can be swung about the pivotally coupled ends of the arms. When the person is to carry the ski boot, his or her fingers are engaged on the taken-out handle of the hanger and the hanger is then swung about the pivotally coupled ends of the coupled arms of the hanger so that the hanger accommodated in a hanger accommodation portion is pulled out from the portion and then grasped by his or her hand to carry the boot. The boot can thus be easily put into the portable state and carried.

It is yet another object of the present invention to provide a ski boot in which a carrying hanger is provided on the outer member of the boot so that a carrying means does not need to be provided separately from the boot and it is easy to put the boot into a portable state and carry the boot. The ski boot includes the outer member, an inner member inserted therein, and the carrying hanger. The hanger has a taken-out handle so that the hanger can be taken out from the outer member and grasped by the hand of a person for him or her to carry the ski boot as the hanger remains coupled with the outer member. The carrying hanger can be moved into and out of a hanger accommodation portion provided inside the outer surface of the outer member. When the person is to carry the ski boot, his or her fingers are engaged on the taken-out handle of the hanger and the hanger is then pulled so that the hanger is put out of the hanger accommodation portion and grasped by his or her hand to carry the boot. The boot can thus be easily put into the portable state and carried.

It is yet another object of the present invention to provide a ski boot in which a carrying hanger is provided on the outer member of the boot so that a carrying means does not need to be provided separately from the boot and it is easy to put the boot into a portable state and carry the boot. The ski boot includes the outer member, an inner member inserted therein, and the carrying hanger provided in a prescribed position on the outer member. The hanger has a taken-out handle so that the hanger can be taken out from the outer member and grasped by the hand of a person for him or her to carry the ski boot as the hanger remains coupled with the outer member. The coupled arms of the hanger, which extend from the taken-out handle of the hanger, are pivotally coupled to the outer member so that the hanger can be swung about the pivotally coupled ends of the arms. The length of the projecting of the handle from the arms can be increased and decreased. When the person is to carry the ski boot, his or her fingers are engaged on the taken-out handle of the hanger to pull out the handle and the hanger accommodated in a hanger accommodation portion provided in the outer surface of the outer member is then pulled up out of the portion so that the hanger is grasped by his or her hand to carry the boot. The boot can thus be easily put in the portable state and carried.

It is yet another object of the present invention to provide a ski boot in which a carrying hanger is provided on the outer member of the boot so that a carrying means does not need to be provided separately from the boot and it is easy to put the boot into a portable state and carry the boot. The ski boot includes the outer member, an inner member inserted therein, and the carrying hanger provided in a prescribed potion on the outer member. The hanger has a taken-out handle so that the hanger can be taken out from the outer member and grasped by the hand of a person for him or her to carry the ski boot as the hanger remains coupled with the outer member. The carrying hanger includes an elongating portion capable of being moved into and out of the outer member, and the taken-out handle supported at the ends of the elongating portion. The elongating portion can be moved into and out of an accommodation portion provided inside the outer surface of the outer member. When the person is to carry the ski boot, the handle of the hanger is put out of another accommodation portion provided in the outer surface of the outer member and is then pulled so that the elongating portion of the hanger is pulled out of the former accommodation portion provided inside the outer surface of the outer member, to increase the length of the projecting of the handle from the outer member, and the handle is then grasped by his or her hand to carry the boot. The boot can thus be easily put into the portable state and carried.

It is yet another object of the present invention to provide a ski boot in which a carrying hanger is provided on the outer member of the boot so that a carrying means does not need to be provided separately from the boot and it is easy to put the boot into a portable state and carry the boot. The ski boot includes the outer member, an inner member inserted therein, and the carrying hanger provided in a prescribed position on the outer member. The hanger has a taken-out handle so that the hanger can be taken out from the outer member and grasped by the hand of a person for him or her to carry the ski boot as the hanger remains coupled with the outer member. The carrying hanger is made of a slender flexible piece and supported at one end of the hanger on one of the inside and outside of the outer member so that the hanger can be swung about the supported end thereof. The hanger can be engaged at the other end thereof on the other of the inside and outside of the outer member. When the person is to carry the ski boot, the hanger is disengaged from one of the outside and inside of the outer member and then engaged with the other of the outside and inside of the member and the hanger is thereafter grasped by his or her and to carry the boot. The boot can thus be easily put into the portable state and carried.

DETAILED DESCRIPTION OF EXEMPLARY EMBODIMENTS

Embodiments of the present invention are hereafter described in detail with reference to the drawings attached hereto.

Figure 1:
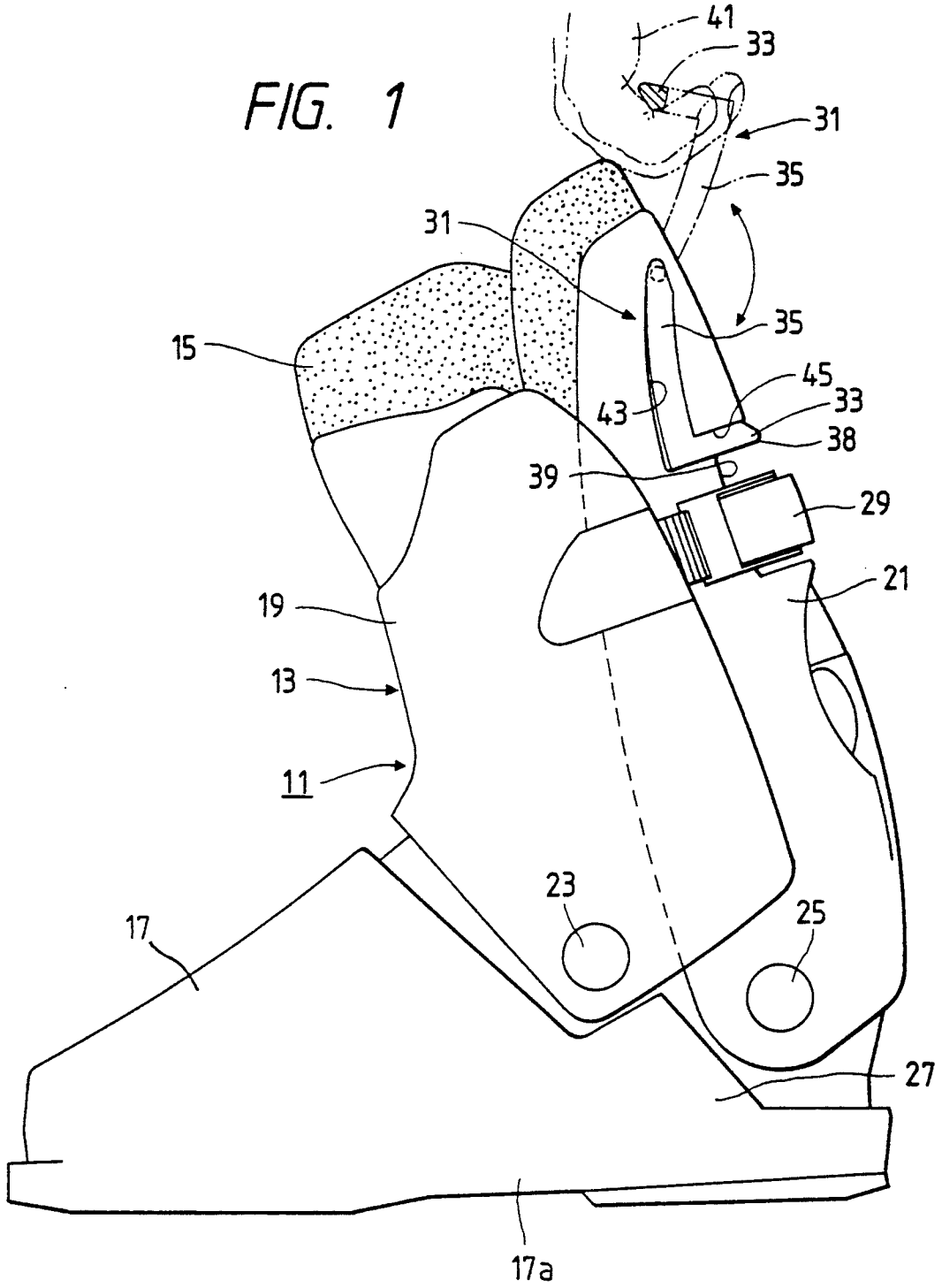
FIG. 1 is a side view of a ski boot which is an embodiment of the present invention.
Figure 2:
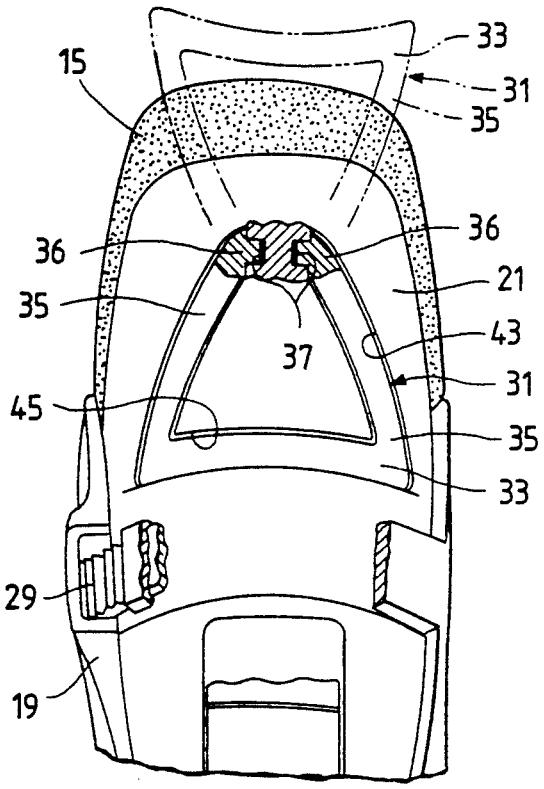
FIG. 2 is a cutaway rear view of the boot.

FIGS. 1 and 2 show a ski boot 11 which is one of the embodiments. The ski boot 11 includes an outer member 13 molded of a hard tenacious synthetic resin, an inner member 15 inserted in the outer member, and a carrying hanger 31. The outer member 13 includes a body 17, which covers the foot of the user of the boot at and below his or her ankle, a sole portion 17*a* which covers the sole of the user, a shin portion 19, which covers his or her ankle and shin, and a calf portion 21, which cover his or her calf above his heel. The shin portion 19 is pivotally coupled at the lower end thereof to the inside and outside ankle parts of the body 17 of the outer member 13 by pivotal coupling pins 23 so that the shin portion can be swung forward. The calf portion 21 is pivotally coupled at the lower end thereof to the heel part of the body 17 of the outer member 13 by pivotal coupling pins 25 so that the calf portion can be swung backward to open. The body 17 of the outer member 13 has stoppers 27 for restricting the backward swing of the shin portion 19. The shin portion 19 is fitted with an ankle tightener 29 for tightening the shin portion and the calf portion 21 to each other to fasten them to each other. The upper part of the rear of the calf portion 21 is fitted with the carrying hanger 31 including a taken-out handle 33, on which the fingers of the user of the ski boot can be engaged to carry it, and coupled arms 35 coupled to the outer surface of the calf portion 21 so that the coupled arms can be swung up and down. The coupled arms 35 extend from the taken-out handle 33 at both the ends thereof. The coupled arms 35 are pivotally coupled to the calf portion 21 so that the arms can be swung into and out of the calf portion. The top parts of the coupled arms 35 have engagement projections or trunnions 36 opposed to each other and fitted in the mutually-opposite engagement recesses 37 of the calf portion 21 so that the coupled arms can be swung relative to the calf portion. The taken-out handle 33 has an oblique outer surface 38 extending obliquely to the direction of the width of the handle so that the lower edge of the handle is located slightly outside the outer surface of the calf portion 21 when the coupled arms 35 are swung down. The calf portion 21 has a recess 39 under the taken-out 33 so that it is easy to engage the fingers 41 of the user on the handle and swing it up. The outer surface of the calf portion 21 of the outer member 13 has arm accommodation recesses 43 and a handle accommodation recess 45, in which the coupled arms 35 and taken-out handle 33 of the carrying hanger 31 are accommodated respectively when the hanger is not in use. The accommodation recesses 43 and 45 extend continuously to each other.

When the ski boot 11 constituted as described above is to be carried by the user thereof, his or her fingers 41 are engaged on the taken-out handle 33 put in the handle accommodation recess 45 of the outer surface of the calf portion 21 of the outer member 13 and are then pulled up so that the carrying hanger 31 put in the accommodation recesses 43 and 45 is swung out of them about the pivotally coupled ends of the coupled arms 35 of the hanger, as shown by two-dot chain lines in FIGS. 1 and 2. The taken-out handle 33 of the hanger 31 is then grasped by the hand of the user to carry the ski boot 11. Thus, the ski boot 11 can be easily put into a portable state, and carried without using a carrying means provided separately from the boot. Therefore, the ski boot 11 has advantages that it is not necessary for the user thereof to carry the separate carrying means with himself or herself, and it is possible for him or her to easily and quickly put the ski boot into the portable state by a pulling the carrying hanger 31 up from the calf portion 21 of the outer member 13 of the boot, even if he or she is wearing gloves on his or her hands on a skiing slope in very cold weather or under a similar condition.

Figure 4:
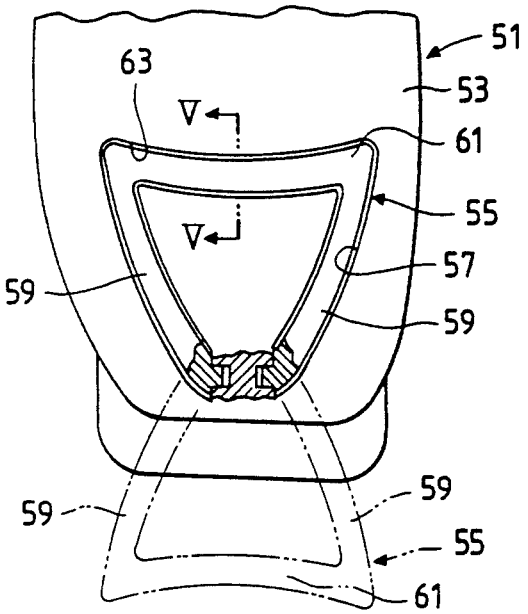
FIG. 4 is a cutaway plan view of the boot shown in FIG. 3.
Figure 5:
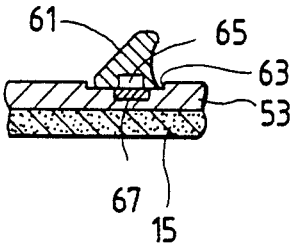
FIG. 5 is a sectional view of the boot along a line V—V shown in FIG. 4.
Figure 3:
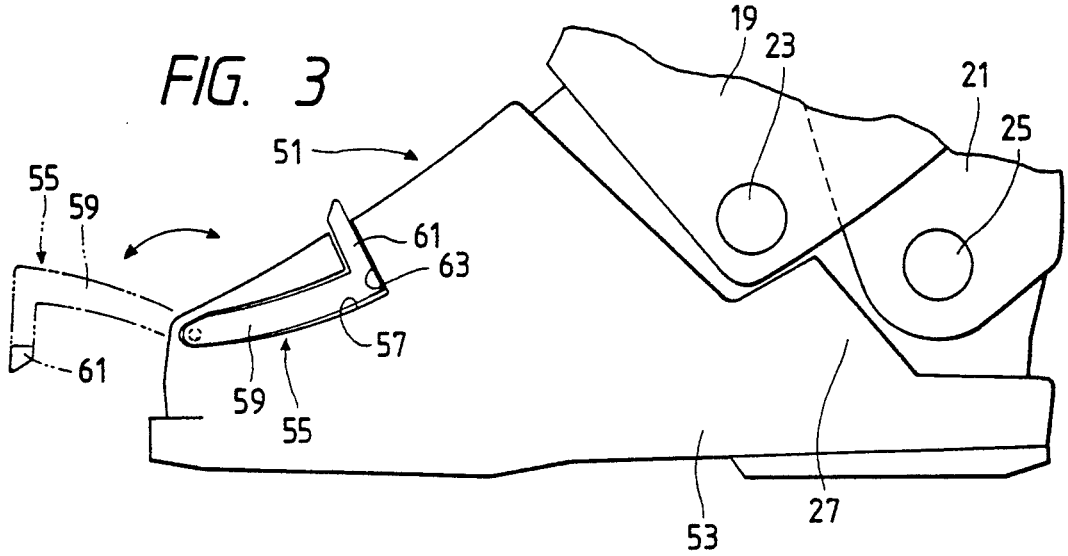
FIG. 3 is a side view of a part of a ski boot which is another embodiment of the present invention.

FIGS. 3 and 4 show a ski boot which is another of the embodiments. In the ski boot, a carrying hanger 55 is provided on the front part of the body 53 of the outer member 51 of the boot. The coupled arms 59 of the carrying hanger 55 are put in arm accommodation recesses 57 provided in the front part of the body 53 of the outer member 51. The coupled arms 59 are pivotally coupled at the front parts thereof to the body 53 of the outer member 51 so that the hanger 55 can be swung about the front parts of the coupled arms. The taken-out handle 61 of the hanger 55 is fitted in a handle accommodation recess 63 provided in the front part of the body 53 of the outer member 51 and extending continuously to the arm accommodation recesses 57. The top of the taken-out handle 61 slightly projects from the outer surface of the body 53 of the outer member 51. As shown in FIG. 5, the surface of the handle 61, which faces the handle accommodation recess 63, is provided with a magnet 65 so that when the handle is put in the recess, the magnet is attracted on a magnetic piece 67 made of iron or the like and provided in the recess.

When the ski boot shown in FIGS. 3 and 4 is to be carried by the user thereof, his or her fingers are engaged on the taken-out handle of the carrying hanger put in the accommodation recesses 57 and 63 and are then pulled up forward, as shown by two-dot chain lines in the drawings. For the reason, the ski boot has the same advantages as that shown in FIGS. 1 and 2 does.

Figure 6:
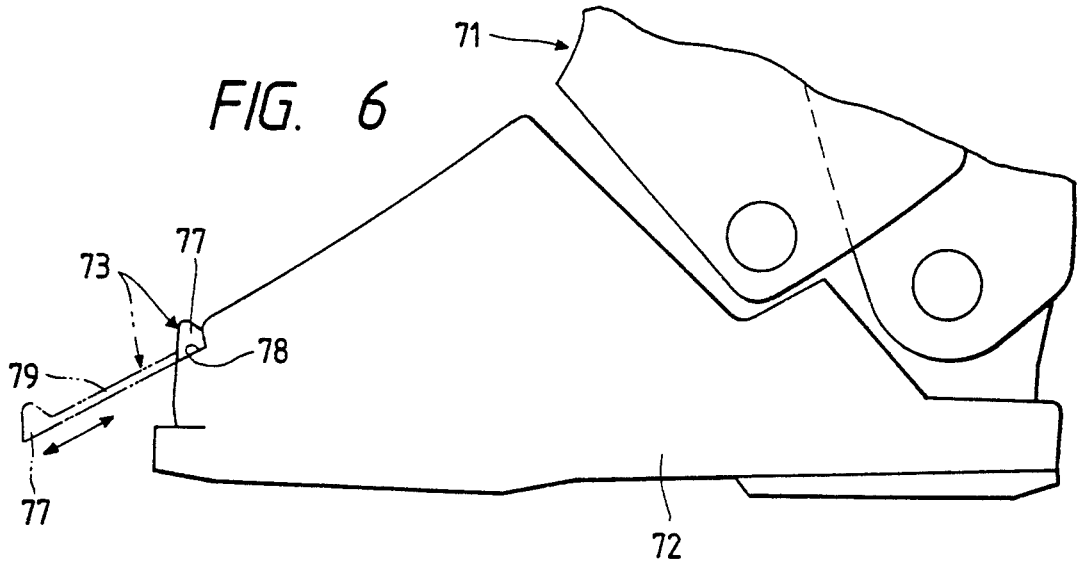
FIG. 6 is a side view of a part of a ski boot which is yet another embodiment of the present invention.
Figure 7:
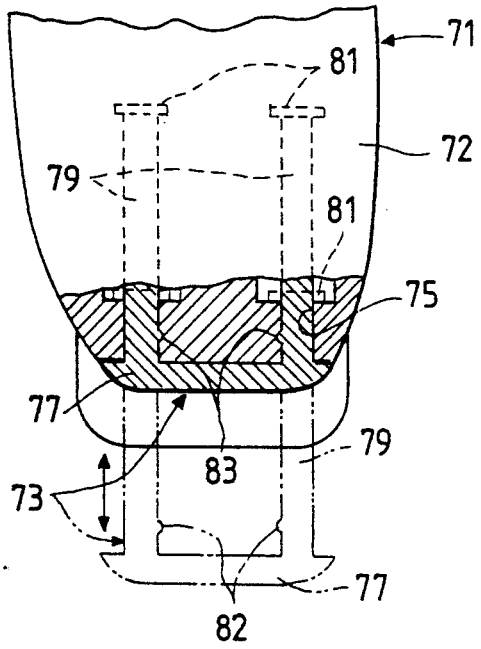
FIG. 7 is a cutaway plan view of the boot shown in FIG. 6.

FIGS. 6 and 7 shown a ski boot which is yet another of the embodiments. In the ski boot, carrying hanger 73 is provided in the front part of the body 72 of the outer member 71 of the boot. The hanger 73 is put in the hanger accommodation portions 75 of the front part of the body 72 of the outer member 71. The taken-out handle 77 of the hanger 73 is put in the handle placing notch 78 of the front part of the outer member body 72. The hanger accommodation portions 75 are made of holes provided in the outer member body 72. The arms 79 of the hanger 73, which extend from the taken-out handle 77 of the hanger at both the ends of the handle, are fitted in the hanger accommodation portions 75 so that the arms can be moved into and out of the outer member body 72. The tips of the arms 79 are formed with stoppers 81 for preventing the carrying hanger 73 from coming off the body 72 of the outer member 51. The holding projections 82 of the arms 79 are engaged in the holding recesses 83 of the inner surfaces of the hanger accommodation portions 75 so as to prevent the hanger 73 from moving out from the outer member body 72 when the hanger is not in use.

When the ski boot shown in FIGS. 6 and 7 is to be carried by the user thereof, the taken-out handle 77 of the carrying hanger 73 of the boot is grasped by his or her hand and then pulled outward so that the hanger is moved out from the hanger accommodation portions 75, as shown by two-dot chain lines in the drawings.

For that reason, the ski boot has the same advantages as that shown in FIGS. 1 and 2 does.

Figure 8:
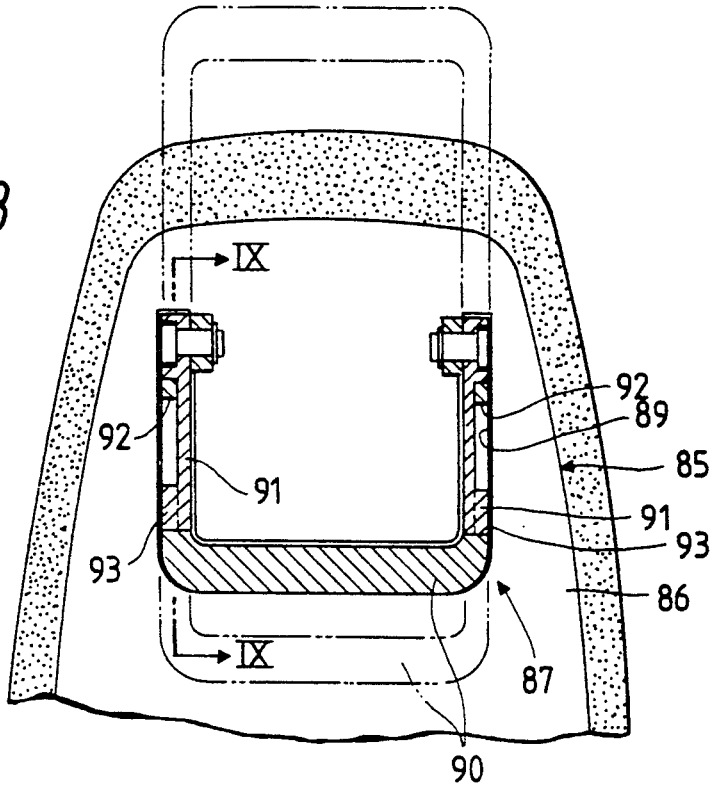
FIG. 8 is a cutaway rear view of a part of a ski boot which is yet another embodiment of the present invention.
Figure 9:
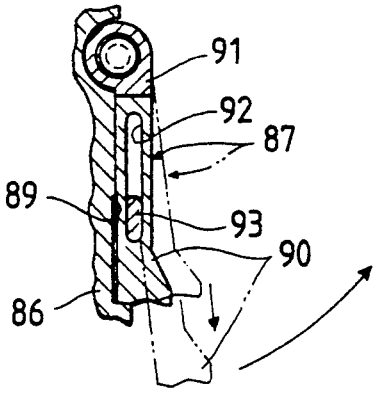
FIG. 9 is a sectional view of the boot along a line IX—IX shown in FIG. 8.
Figure 10:
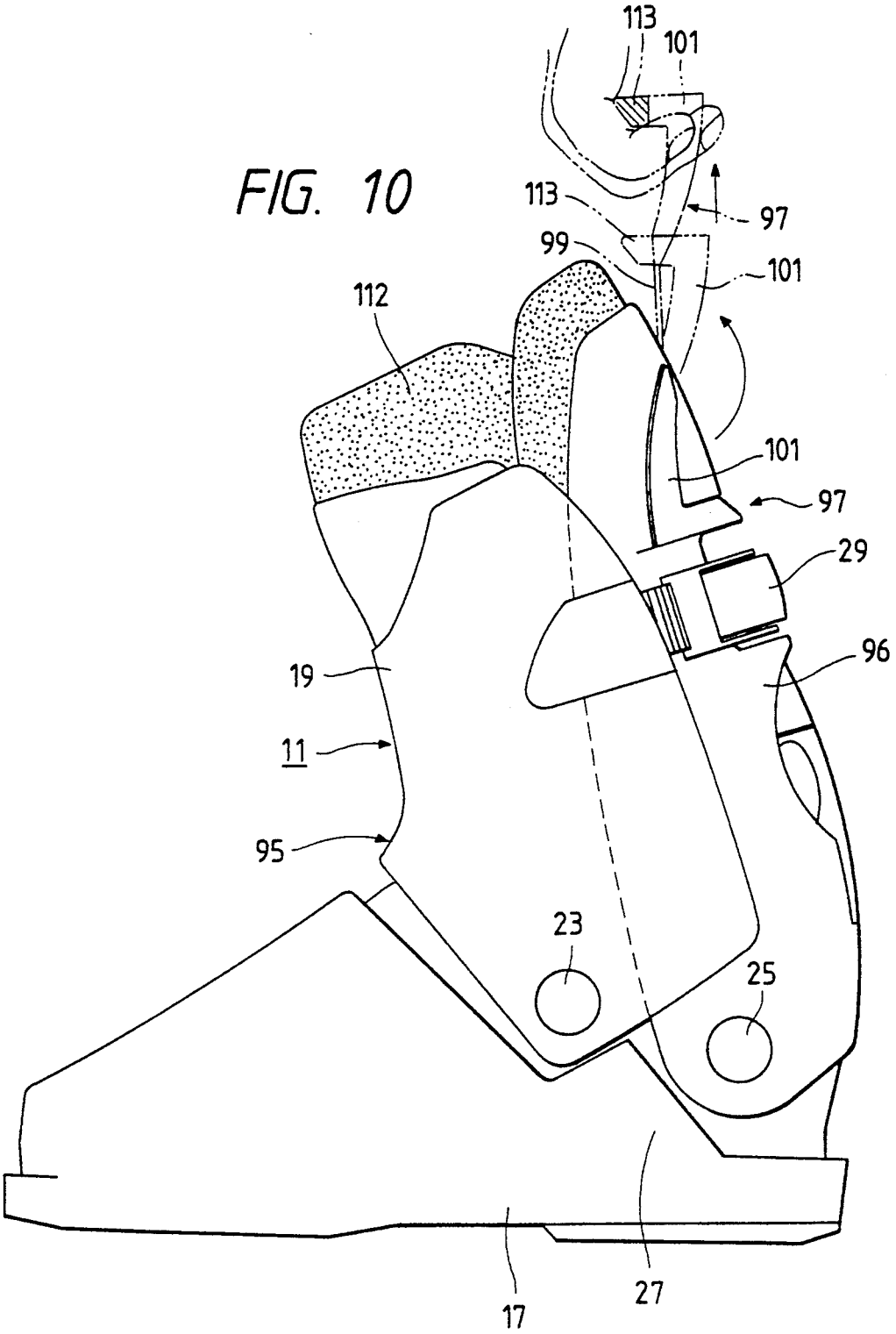
FIG. 10 is a side view of a ski boot which is yet another embodiment of the present invention.
Figure 11:
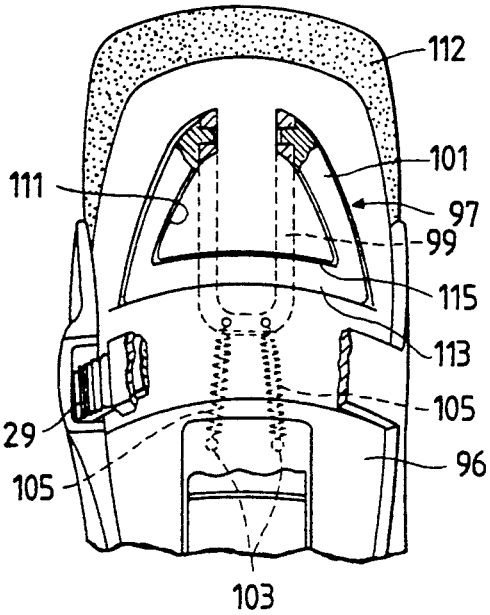
FIG. 11 is a rear view of the upper part of the calf portion of the boot shown in FIG. 10 and the vicinity of the part.
Figure 12:
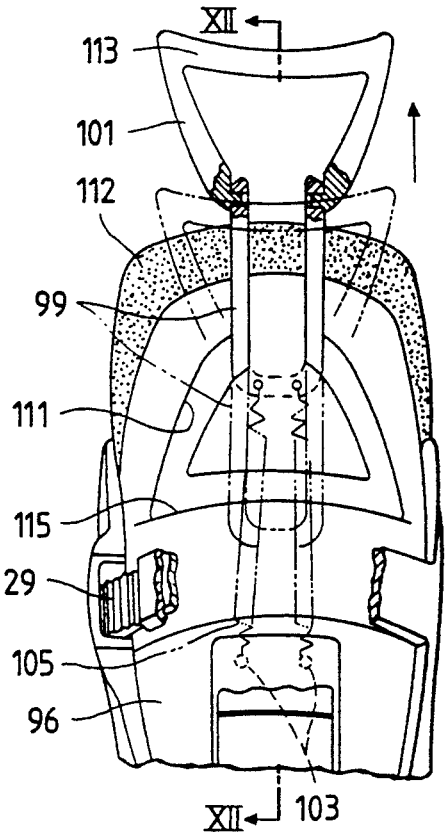
FIG. 12 is a rear view of the carrying hanger of the boot shown in FIG. 11, in the state of use of the hanger.

FIGS. 8 and 9 show a part of a ski boot which is yet another of the embodiments. In the ski boot, a carrying hanger 87 is provided on the upper part of rear of the calf portion 86 of the outer member 85 of the boot. The hanger 87 is put in a hanger accommodation recess 89 provided in the outer surface of the calf portion 86. The coupled arms 91 of the hanger 87, which extend from the taken-out handle of the hanger at both the ends of the handle, are pivotally coupled to the calf portion 86 so that the hanger can be swung about the pivotally coupled tips of the arms. The handle 90 is shaped as U and has slender guide holes 92 at both the ends of the handle. The guide portions 93 of the coupled arms 91 are movably fitted in the slender guide holes 92 of the handle 90 so that the handle can be moved relative to the arms to alter the length of the projecting of the handle from the arms.

When the ski boot shown in FIGS. 8 and 9 is to be carried by the user thereof, his or her hand is engaged on the taken-out handle 90 of the carrying hanger and pulled to draw down the handle to increase the length of the projecting of the handle from the arms 91 of the hanger and the handle is thereafter swung up about the tips of the arms so that the hanger is pulled up out of the hanger accommodation recess 89 of the outer surface of the calf portion 86 of the outer member 85, as shown by two-dot chain lines in the drawings. For that reason, the ski boot has the same advantages as that shown in FIGS. 1 and 2 dose.

Figure 13:
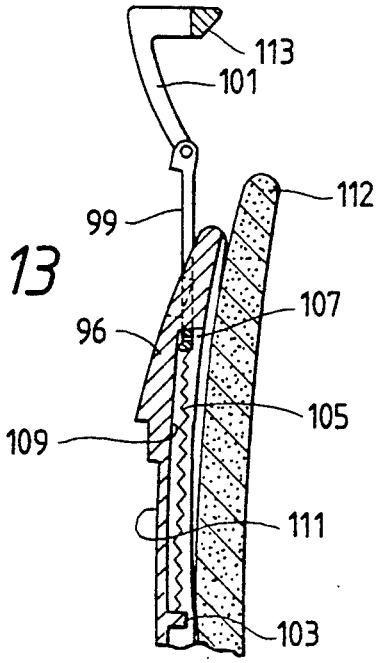
FIG. 13 is a sectional view of the boot along a line XII—XII shown in FIG. 12.

FIGS. 10, 11, 12 and 13 show a ski boot which is yet another of the embodiments. In the ski boot, carrying hanger 97 is provided on the upper part of rear of the calf portion 96 of the outer member 95 of the boot. The hanger 97 includes an elongating portion 99, which can be moved into and out of the calf portion 96, and a taken-out handle 101 coupled to the elongating portion 99 so that the handle can be swung about the ends of the elongating portion. The elongating portion 99 is shaped as U. As shown in FIG. 13, a spring 105 is secured at one end thereof to a projection 103 formed on the inner surface of the calf portion 96, and is secured at the other end of the spring to the central part of the elongating portion 99 so that the portion is always urged inward by the spring. The handle 101 is pivotally coupled at both the ends thereof to those of the elongating portion 99 so that the handle can be swung about the ends of the port ion. The ski boot has a hanger accommodation part 107, in which the carrying hanger 97 is accommodated. The accommodation part 107 includes an accommodation opening 109 provided in the inner surface of the calf portion 96 of the outer member 95 so as to accommodate the elongating portion 99 of the hanger 97, and a recess 111 provided in the outer surface of the calf portion so as to accommodate the handle 101 of the hanger. The accommodation opening 109 is defined by a recess provided in the inner surface of the calf portion 96 of the outer member 95, and the inner member 112 of the ski boot. The handle 101 has a taken-out portion 113, which is put in the taken-out portion accommodation section 115 of the hanger accommodation part 107.

When the ski boot shown in FIGS. 10, 11, 12 and 13 is to be carried by the user thereof, his or her hand is engaged on the taken-out portion 113 put in the taken-out portion accommodation section 115 of the outer surface of the calf portion 96 and the handle 101 of the carrying hanger 97 is then pulled out of the recess 111 of the outer surface of the calf portion as shown by two-dot chain lines, so that the elongating portion 99 of the hanger is drawn out from the accommodation opening 109 as shown by full lines in the drawings. For that reason, the ski boot has the same advantages as that shown in FIGS. 1 and 2 does.

Figure 16:
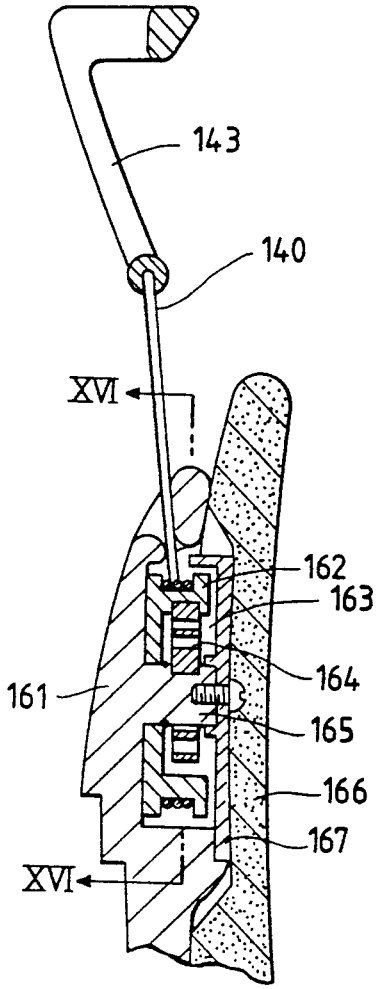
FIG. 16 is a sectional view of the boot along a line XV—XV shown in FIG. 15.
Figure 17:
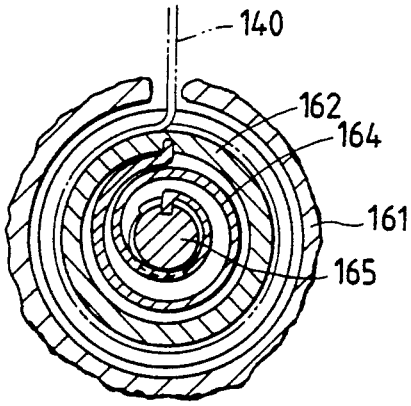
FIG. 17 is a sectional view of the boot along a line XVI—XVI shown in FIG. 16.

FIGS. 14, 15, 16 and 17 show a part of a ski boot which is yet another of the embodiments. In the ski boot, a carrying hanger 143 has an elongating portion 140 which can be moved into and out of the calf portion 161 of the outer member of the boot. In other words, the elongating portion 140 is urged by a spiral spring 164 so that the elongating portion is pulled into the calf portion 161 in the use of the ski boot and can be pulled out of the calf portion against the urging force of the spring in the non-use of the ski boot. FIG. 16 is a sectional view of the ski boot along a line XV—XV shown in FIG. 15. FIG. 17 is a sectional view of the ski boot along a line XVI—XVI shown in FIG. 16. The ski boot includes the calf portion 161, a reel 162, an accommodation opening 163, the spiral spring 164, a boss 165, an inner member 166, and a holding plate 167.

Figure 14:
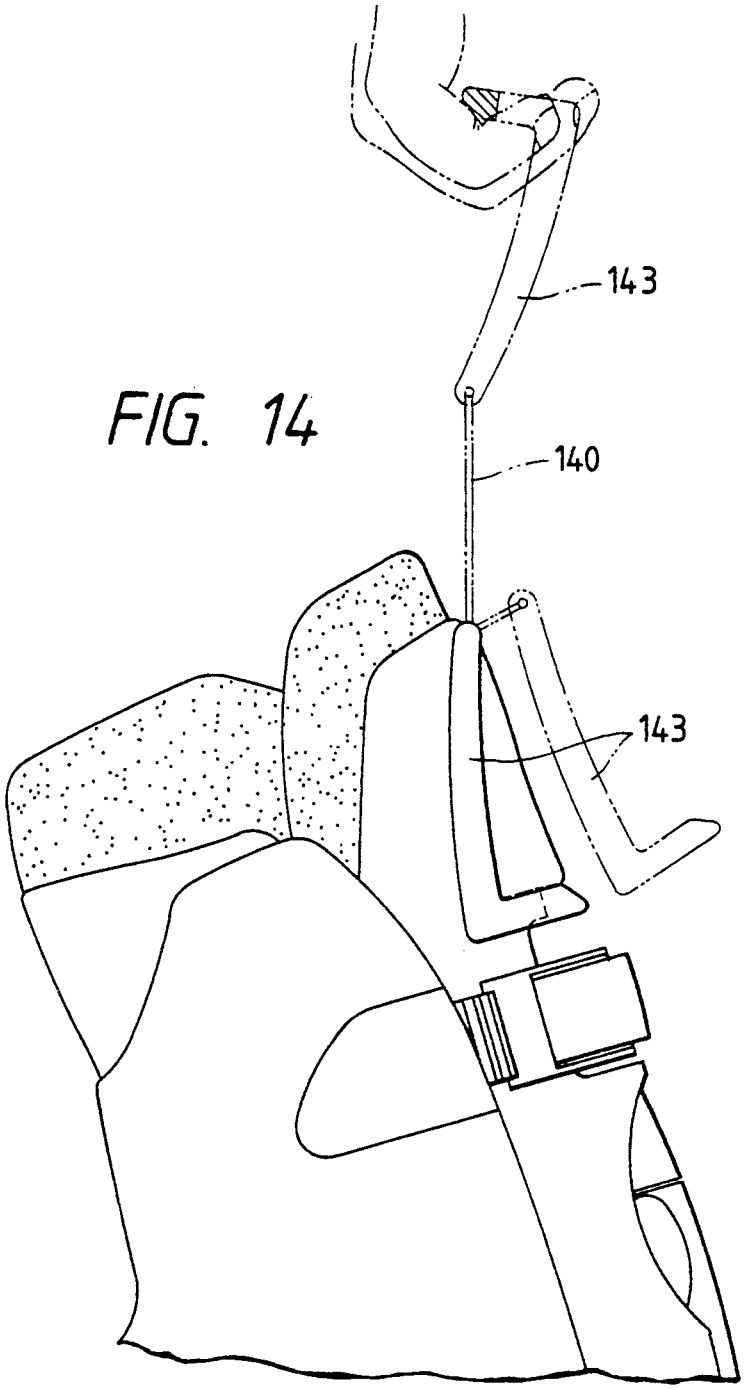
FIG. 14 is a side view of a ski boot which is another embodiment of the present invention.
Figure 15:
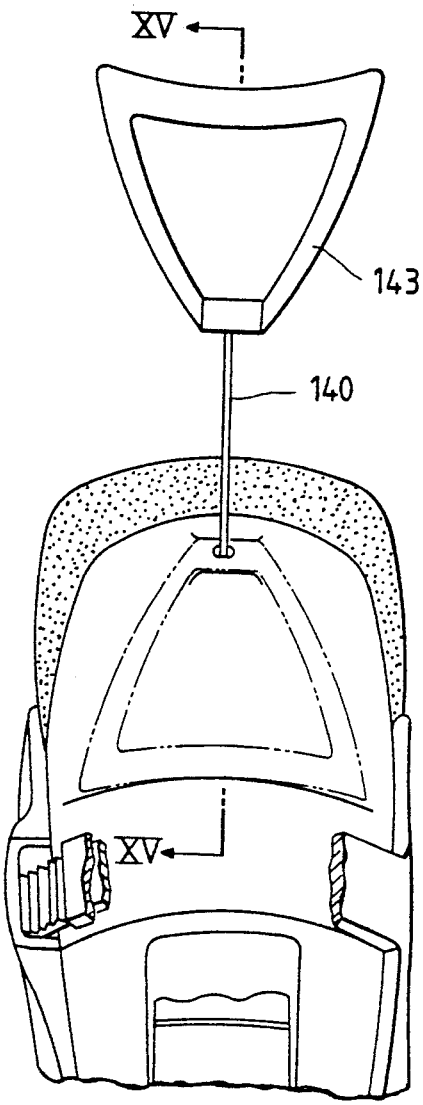
FIG. 15 is a cutaway rear view of the boot shown in FIG. 14.

When the ski boot shown in FIGS. 14, 15, 16 and 17 is to be carried by the user thereof, his or her hand is engaged on the handle of the carrying hanger 143 and the handle is then swung up about the upper end of the elongating portion 140 and pulled up so that the elongating portion 140 and pulled up so that the elongating portion is moved out to increase the length of the projecting of the hanger from the calf portion 161, as shown by two-dot chain lines in FIG. 14. For that reason, the ski boot has the same advantages as that shown in FIGS. 1 and 2 does.

Figure 18:
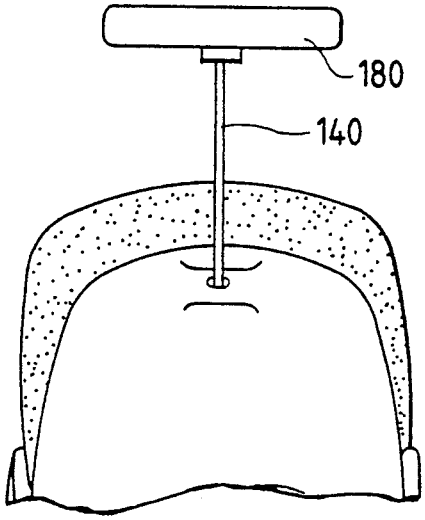
FIG. 18 is a cutaway rear view of a carrying hanger which is a modification of the carrying hanger of the boot shown in FIG. 14.
Figure 19:
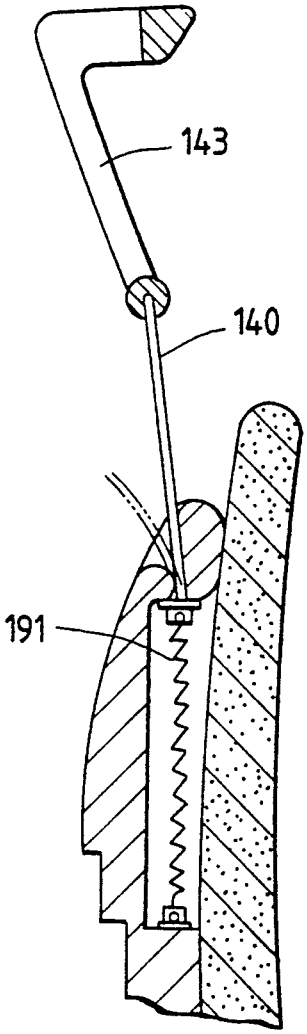
FIG. 19 is a sectional view of a carrying hanger which is another modification of the carrying hanger of the boot shown in FIG. 14, along the line XV—XV shown in FIG. 15.
Figure 20:
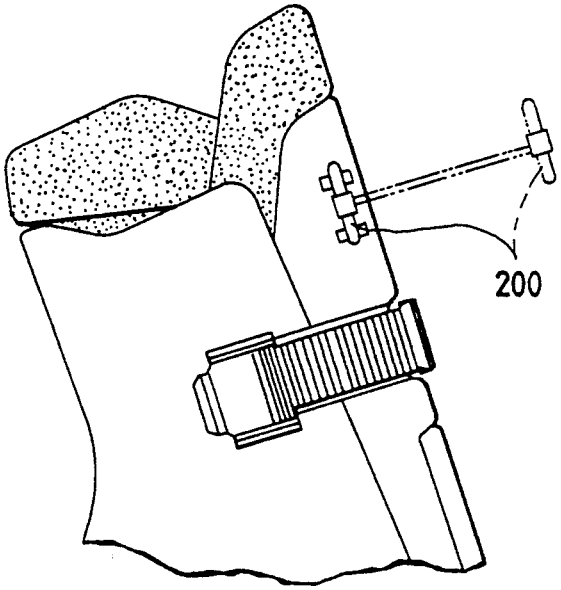
FIG. 20 is a side view of a part of a ski boot which is yet another embodiment of the present invention.
Figure 21:
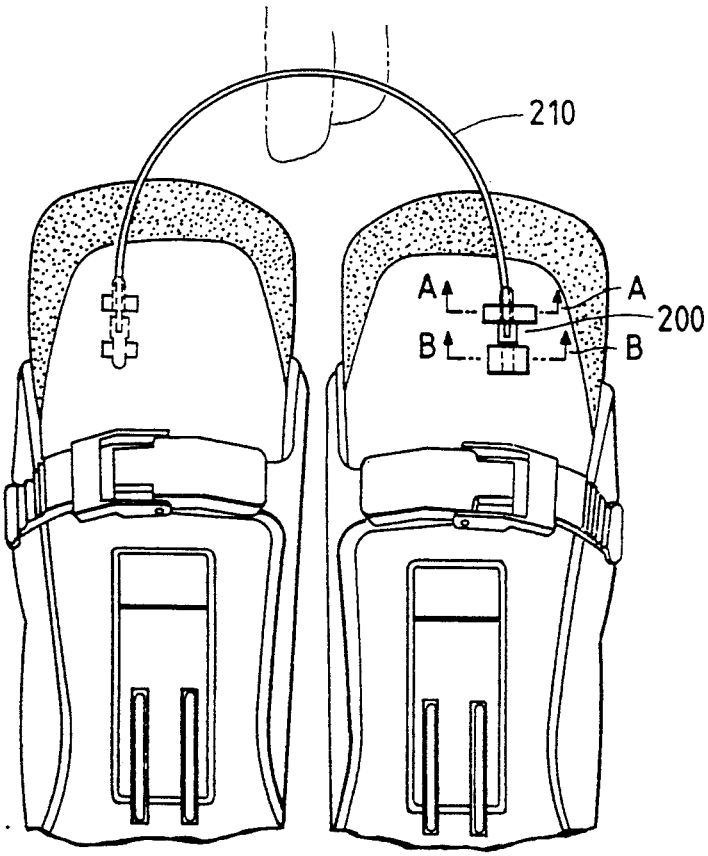
FIG. 21 is a cutaway rear view of the part shown in FIG. 20.

FIG. 18 shows a carrying hanger 180 which is a modification of the carrying hanger 143 FIG. 19 shows a helical spring 191 which is a modification of the spiral spring 164.

Figure 22:
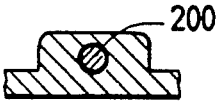
FIG. 22 is a sectional view of the part along a line A—A shown in FIG. 21.
Figure 23:
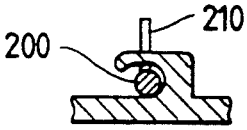
FIG. 23 is a sectional view of the part along a line B—B shown in FIG. 21.
Figure 24:
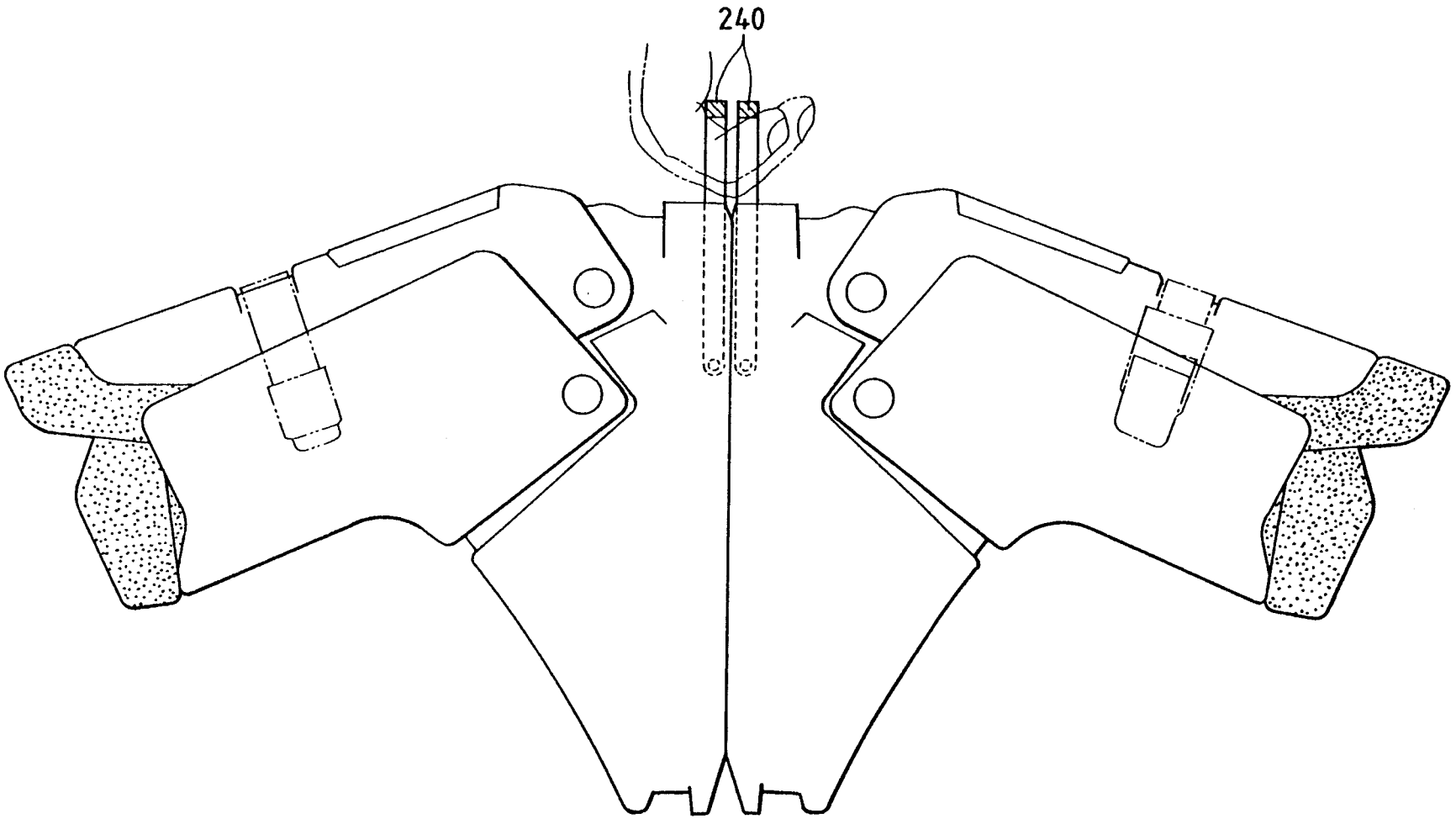
FIG. 24 is a side view of a ski boot which is yet another embodiment of the present invention.
Figure 25:
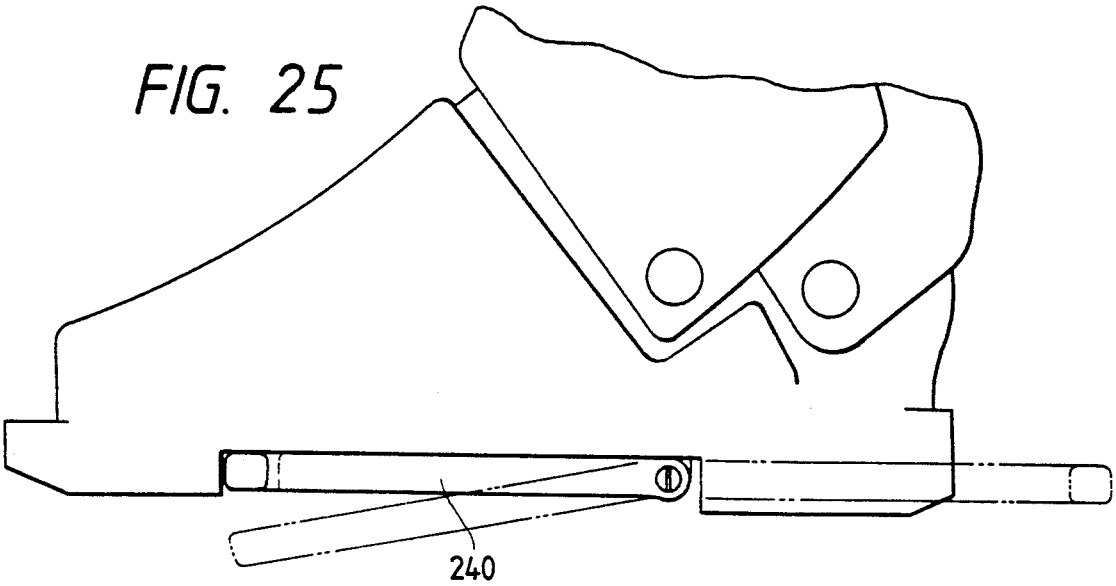
FIG. 25 is a side view of the body of the outer member of the boot shown in FIG. 24 and the vicinity of the body.
Figure 26:
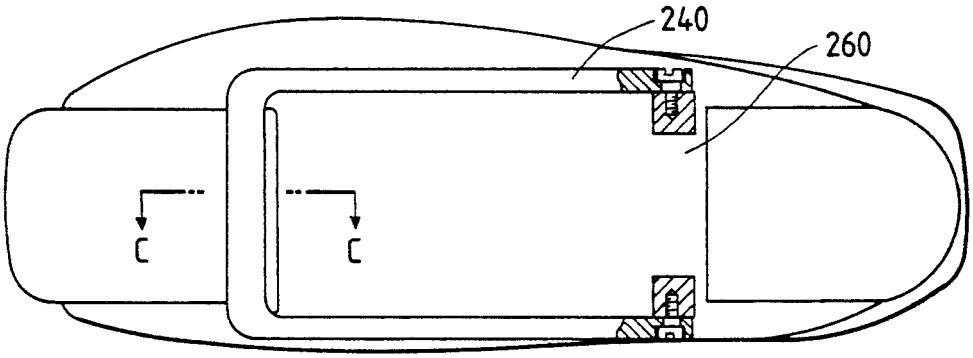
FIG. 26 is a bottom view of the boot shown in FIG. 24.

FIGS. 20, 21, 22 and 23 show a ski boot which is yet another of the embodiments. The ski boot includes an elongating portion 210 similar to that of the ski boot shown in FIGS. 14, 15, 16 and 17, and a taken-out part 200 at the tip of the elongating portion. When the elongating portion 210 is pulled out from the calf portion of the ski boot, the taken-out part 200 can be engaged with the engagement portion of another ski boot to keep the elongating portion pulled out. The pair of the ski boots can thus be easily carried together. For that reason, the ski boot shown in FIGS. 20, 21, 22 and 23 has the same advantages as that shown in FIGS. 1 and 2 does. FIGS. 22 and 23 are sectional views of the ski boot along lines A—A and B—B shown in FIG. 21, and show the engagement of the taken-out part 200 and the engagement portion.

Figure 27:
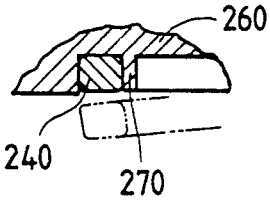
FIGS. 27 and 28 are sectional views of the boot along a line C—C shown in FIG. 26.
Figure 28:
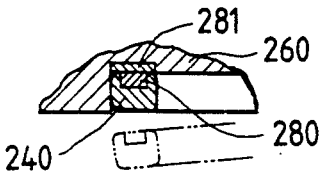
Figure 30:
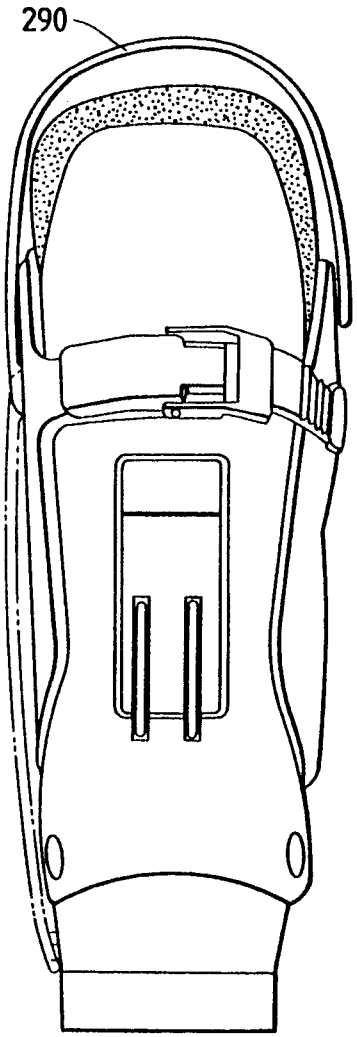
FIG. 30 is a rear view of the boot shown in FIG. 29.

FIGS. 24, 25, 26 and 27 show a ski boot which is yet another of the embodiments. The ski boot includes a carrying hanger 240 pivotally coupled to the bottom of the boot so that the hanger can be swung from an inner position to an outer position about the pivotally coupled ends of the hanger. FIG. 27 is a sectional view of the ski boot along a line C—C shown in FIG. 26, and indicates that the carrying hanger 240 is engaged with the elastic engagement portion 270 of the boot at the bottom 260 thereof. FIG. 28 is a sectional view of a ski boot which is a modification of the ski boot shown in FIGS. 24, 25, 26 and 27. FIG. 28 corresponds to FIG. 26, and indicates that a magnet 280 is provided on a carrying hanger 240, and a magnetic plate 281 provided on the bottom of the ski boot so as to attract the magnet on the magnetic plate to hold the carrying hanger on the bottom of the boot.

When each of the ski boots shown in FIGS. 24, 25, 26, 27 and 28 is to be carried by the user thereof, his or her hand is engaged on the carrying hanger and the hanger is then swung around from the inner position to the outer position. A pair of such ski boots can thus be easily carried as their carrying hangers 240 are grasped by the hand of the user. For that reason, the ski boots have the same advantages as that shown in FIGS. 1 and 2 does.

FIGS. 29, 30, 31, 32, 33 and 34 show a ski boot which is yet another of the embodiments. The ski boot includes a carrying hanger 290 made of a slender flexible piece and pivotally coupled at one end thereof to one of the inside and outside of the outer member of the ski boot so that the hanger can be swung about the pivotally coupled end thereof. An engagement part 330 provided on the hanger 290 at the other end thereof can be engaged in the engagement hole 320 of the other of the inside and outside of the outer member of the boot when the hanger is swung up to carry the boot. When the ski boot is put in use, namely, it is not carried, the engagement part 330 provided on the carrying hanger 290 is engaged in another engagement hole 310 provided in the side of the outer member opposite the former engagement hole 320.

Figure 29:
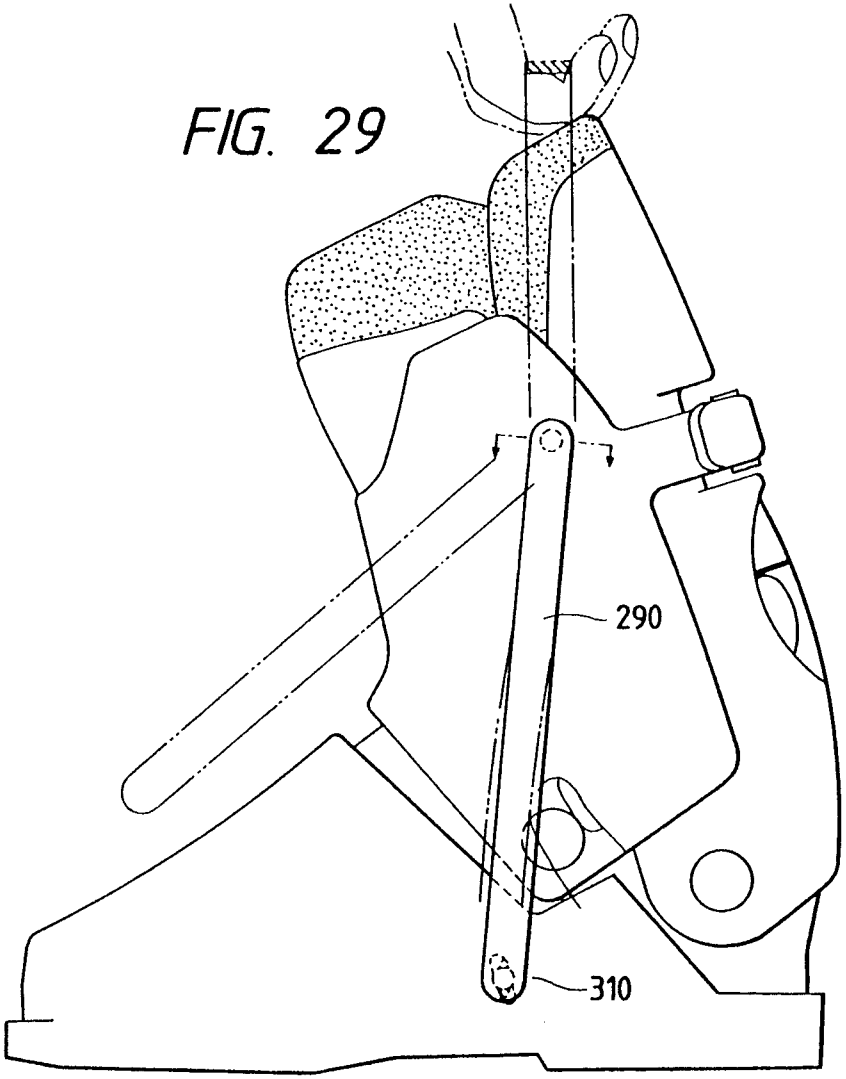
FIG. 29 is a side view of a ski boot which is yet another embodiment of the present invention.
Figure 31:
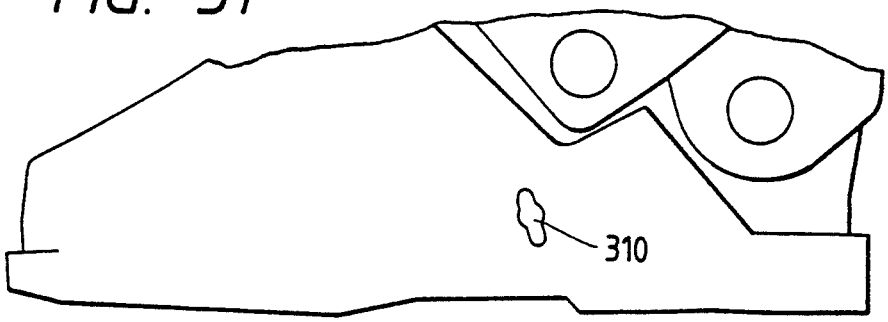
FIG. 31 is a side view of the body of the outer shell of the boot shown in FIG. 29 and the vicinity of the body.
Figure 32:
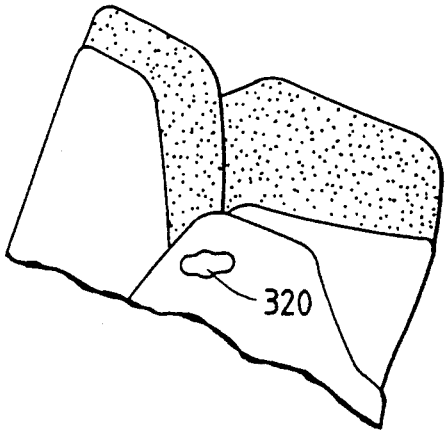
FIG. 32 is a side view of the outer member of the boot shown in FIG. 29.
Figure 33:
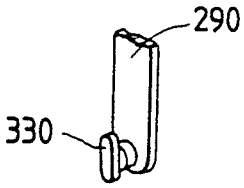
FIG. 33 is a prescribed view of the engagement part of the carrying hanger of the boot shown in FIG. 29.
Figure 34:
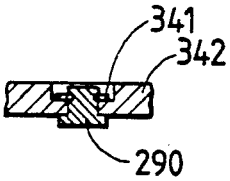
FIG. 34 is a sectional view of the boot along a line D—D shown in FIG. 29.

When the ski boot shown in FIGS. 29, 30, 31, 32, 33 and 35 is to be carried by the user thereof, the engagement part 330 is disengaged out of the engagement hole 310 and then engaged in the other engagement hole 320 so that the carrying hanger 290 is grasped by his or her hand, as shown by two-dot chain lines in FIG. 29, to carry the boot. For that reason, the ski boot has the same advantages as that shown in FIGS. 1 and 2 does.

Figure 35:
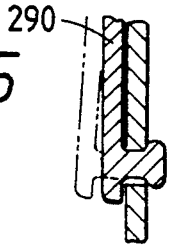
FIGS. 35 and 36 are sectional views indicating the engaged states of the engagement parts and engagement holes of carrying hangers and outer members of ski boots which are modifications of the ski boot shown in FIG. 29.
Figure 36:
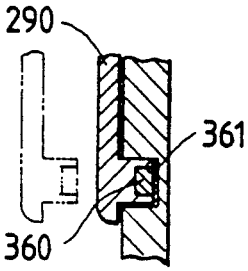

FIGS. 35 and 36 show parts of ski boots which are modifications of the ski boot shown in FIGS. 29, 30, 31, 32, 33 and 34. In the ski boot shown in FIG. 35, an engagement part 330 and an engagement hole 320 constitute an elastic engagement means. In the ski boot shown in FIG. 36, a magnet 360 provided on a carrying hanger and a magnetic plate 361 provided on an outer member constitute a magnetic engagement means.

The present invention is not confined to the embodiments described above, but may be embodied or practiced in other ways without departing from the spirit or essential character thereof. For example, the carrying hanger may be provided or the shin portion of the outer member of the boot, and the ankle tightener may be provided on the front of the shin portion.

What is claimed is:

1. A ski boot comprising:

an outer member including a recess in an exterior of said outer member wherein said outer member comprises a body portion adapted to cover a top portion and side portions of a skier's foot, a shin portion adapted to cover the skier's shin, a calf portion adapted to cover the skier's calf, and a sole portion adapted to cover the skier's sole;

an inner member inserted inside said outer member and adapted to receive a skier's foot;

a first independent coupling arm having a first end and a second end;

a second independent coupling arm having a first end and a second end;

a handle connected to said first ends of said first and second independent coupling arms; and pivot means for pivotally coupling said second ends of said first and second independent coupling arms to at least one of said body portion, said shin portion and said calf portion of said outer member, said pivot means comprising trunnions rotatably received within pivotal seats;

wherein said handle is adapted to be grasped for carrying said ski boot, and pivots between a carrying position and a seated position, said first and second independent coupling arms and said handle being received in said recess in said seated position.

2. The ski boot according to claim 1, wherein said trunnions are mounted on said second ends of said first and second independent coupling arms, and said pivotal seats are mounted on said outer member.

3. The ski boot according to claim 1, wherein said first independent coupling arm, said second independent coupling arm, and said handle are substantially received in said recess.

4. The ski boot according to claim 1, further comprising:

holding means for holding said handle in said recess.

5. The ski boot according to claim 4, wherein said holding means comprises a magnet.

6. The ski boot according to claim 1, wherein said shin portion is pivotally coupled at a lower end thereof to said body portion and said calf portion is pivotally coupled at a lower end thereof to said body portion.

7. The ski boot according to claim 6, wherein said recess is in said calf portion and is adapted to receive said handle; and wherein said recess is larger than said handle and is adapted to facilitate grasping of said handle when said handle is received in said recess.

8. A ski boot comprising:

an outer member including a recess in an exterior of said outer member wherein said outer member comprises a body portion adapted to cover a top portion and side portions of a skier's foot, a shin portion adapted to cover the skier's shin, a calf portion adapted to cover the skier's calf, and a sole portion adapted to cover the skier's sole;

an inner member inserted inside said outer member and adapted to receive a skier's foot;

a first independent coupling arm having a first end and a second end;

a second independent coupling arm having a first end and a second end;

a handle connected to said first ends of said first and second independent coupling arms; and pivot means for pivotally coupling said second ends of said first and second independent coupling arms to at least one of said body portion, said shin portion and said calf portion of said outer member, said pivot means comprising trunnions rotatably received within pivotal seats;

an elongated member slidably mounted on said outer member, said elongated member having a first end adapted to be retained by said outer member and a second end adapted to extend outside said outer member;

wherein said pivot means is pivotally coupled to at least one of said body portion, said shin portion, and said calf portion of said outer member through said elongated member, said pivot means being connected to said second end of said elongated member; and wherein said elongated member is slidable relative to said outer member between a recessed position in which said second end of said elongated member is proximal to said outer housing and an extended position in which said second end of said elongated member is extended from said outer housing.

9. The ski boot according to claim 8, wherein said elongated member is slidably mounted in said recess in said outer member.

10. The ski boot according to claim 8, further comprising:

resilient means for urging said elongated member toward said recessed position.

* * * * *